US009624762B2

(12) United States Patent
Kyllingstad

(10) Patent No.: US 9,624,762 B2
(45) Date of Patent: Apr. 18, 2017

(54) SYSTEM AND METHOD FOR REDUCING DRILLSTRING OSCILLATIONS

(71) Applicant: National Oilwell Varco Norway AS, Stavanger (NO)

(72) Inventor: Age Kyllingstad, Algard (NO)

(73) Assignee: NATIONAL OILWELL VARCO NORWAY AS, Stavanger (NO)

( * ) Notice: Subject to any disclaimer, the term of this patent is extended or adjusted under 35 U.S.C. 154(b) by 452 days.

(21) Appl. No.: 14/374,494

(22) PCT Filed: Jan. 17, 2013

(86) PCT No.: PCT/NO2013/050014
§ 371 (c)(1),
(2) Date: Jul. 24, 2014

(87) PCT Pub. No.: WO2013/112056
PCT Pub. Date: Aug. 1, 2013

(65) Prior Publication Data

US 2014/0360779 A1 Dec. 11, 2014

(30) Foreign Application Priority Data

Jan. 24, 2012 (NO) ..... 20120073

(51) Int. Cl.
*E21B 44/00* (2006.01)
*E21B 41/00* (2006.01)

(52) U.S. Cl.
CPC ..... *E21B 44/00* (2013.01); *E21B 41/0092* (2013.01)

(58) Field of Classification Search
CPC ..... E21B 44/00; E21B 41/00; E21B 41/0092; Y10S 254/90
See application file for complete search history.

(56) References Cited

U.S. PATENT DOCUMENTS 5,117,926 A 6/1992 Worrall et al.
6,166,654 A * 12/2000 Van Den Steen ..... E21B 44/00 340/853.3

(Continued)

FOREIGN PATENT DOCUMENTS

WO 2010/063982 A1 6/2010
WO 2010/064031 A1 6/2010

OTHER PUBLICATIONS

PCT/NO2013/050014 International Search Report and Written Opinion dated Apr. 19, 2013 (7 p.).

(Continued)

*Primary Examiner* — Daniel P Stephenson
(74) *Attorney, Agent, or Firm* — Conley Rose, P.C.

(57) ABSTRACT

A drillstring with a bit is characterized by controllable variables of vertical and rotational speeds and response variables of axial tension force and torque, referenced to the top of the drillstring. A method of reducing or avoiding at least an axial or a torsional oscillation mode in the drillstring includes:

choosing at least one oscillation mode to be controlled;

selecting and monitoring a relevant controllable variable and a relevant response variable;

determining the oscillation period;

estimating from the response variable a dynamic component of bit speed;

determining a speed pulse capable of producing a generated oscillation with amplitude substantially equal to the amplitude of the dynamic component of bit speed; and Using open-loop control to add the speed pulse to an operator set speed command when the dynamic com- (Continued)

ponent of bit speed has an amplitude exceeding a threshold level and an anti-phase matching a phase of the generated oscillation.

19 Claims, 6 Drawing Sheets

(56) References Cited

U.S. PATENT DOCUMENTS

| | | | | |
|---|---|---|---|---|
| 8,689,906 | B2 * | 4/2014 | Nessjoen | E21B 44/00 175/24 |
| 8,950,512 | B2 * | 2/2015 | Nessjoen | E21B 44/00 175/24 |
| 9,297,743 | B2 * | 3/2016 | Conn | G01N 19/02 |
| 2006/0225920 | A1 * | 10/2006 | Treviranus | E21B 47/18 175/40 |
| 2011/0232966 | A1 * | 9/2011 | Kyllingstad | E21B 44/00 175/24 |
| 2011/0245980 | A1 * | 10/2011 | Nessjoen | E21B 44/00 700/280 |
| 2012/0130693 | A1 * | 5/2012 | Ertas | E21B 44/00 703/2 |
| 2014/0360779 | A1 * | 12/2014 | Kyllingstad | E21B 41/0092 175/24 |

OTHER PUBLICATIONS

Perreau, P.J., et al., "New Results in Real Time Vibrations Prediction," 6th Abu Dhabi International Petroleum Exhibition and Conference, Abu Dhabi, U.A.E., Oct. 11-14, 1998, pp. 190-200 (SPE 49479) (11 p.).

Christoforou, Andreas P., et al., "Active Control of Stick-Slip Vibrations: The Role of Fully Coupled Dynamics," 2001 Middle East Oil Show, Bahrain, Mar. 17-20, 2001 (SPE 68093) (7 p.).

Halsey, G.W., et al., "Drillstring Torsional Vibrations: Comparisons between Theory and Experiment on a Full-Scale Research Drilling Rig," 61st Annual Technical Conference and Exhibition of the Society of Petroleum Engineers, New Orleans, Louisiana, Oct. 5-6, 1986 (SPE 15564) (10 p.).

Halsey, G.W., et al., "Torque Feedback Used to Cure Slip-Stick Motion," 63rd Annual Technical Conference and Exhibition of the Society of Petroleum Engineers, Houston,Texas, Oct. 2-5, 1988 (SPE 18049) (6 p.).

Kyllingstad, Age, and Nessjon0en, Jacob, "Hardware-in-the-Loop Simulations Used as a Cost Efficient Tool for Developing an Advanced Stick-Slip Prevention System," 2010 IADC/SPE Drilling Conference and Exhibition, New Orleans, Louisiana, Feb. 2-4, 2010 (SPE 128223) (13 p.).

Jansen, J.D., et al., "Active Damping of Torsional Drillstring Vibrations With a Hydraulic Top Drive," SPE Drilling & Completion, Dec. 1995, pp. 250-254 (SPE 28911) (5 p.).

* cited by examiner

SYSTEM AND METHOD FOR REDUCING DRILLSTRING OSCILLATIONS

CROSS-REFERENCE TO RELATED APPLICATIONS

This application is a 35 U.S.C. §371 national stage application of PCT/NO2013/050014 filed Jan. 17, 2013 and entitled "Method for Reducing Drillstring Oscillations," which claims priority to Norwegian Application No. 20120073 filed Jan. 24, 2012 and entitled "Method for Reducing Drillstring Oscillations," both of which are hereby incorporated herein by reference in their entirety for all purposes.

STATEMENT REGARDING FEDERALLY SPONSORED RESEARCH OR DEVELOPMENT

Not applicable.

BACKGROUND

Field of the Disclosure

The present disclosure relates to a method of removing or substantially reducing stick-slip oscillations in a drillstring, to a method of drilling a borehole, to drilling mechanisms for use in drilling a borehole, and to an electronic controller for use with a drilling mechanism.

Background to the Disclosure

Drilling an oil and/or gas well involves creation of a borehole of considerable length, often up to several kilometers vertically and/or horizontally by the time production begins. A drillstring comprises a drill bit at its lower end and lengths of drill pipe that are screwed together. The whole drillstring is turned by a drilling mechanism at the surface, which in turn rotates the bit to extend the borehole. The rotational part of the drilling mechanism is typically a topdrive consisting of one or two motors with a reduction gear rotating the top drillstring with sufficient torque and speed. A machine for axial control of the drilling mechanism is typically a winch (commonly called drawworks) controlling a travelling block, which is connected to and controls the vertical motion of the topdrive.

The drillstring is an extremely slender structure relative to the length of the borehole, and during drilling the drillstring is twisted several turns due to the total torque needed to rotate the drillstring and the bit. The torque may typically be on the order of 10-50 kNm. The drillstring also displays a complicated dynamic behavior comprising axial, lateral and torsional vibrations. Simultaneous measurements of drilling rotation at the surface and at the bit have revealed that the drillstring often behaves as a torsional pendulum, i.e. the top of the drillstring rotates with a constant angular velocity, whereas the drill bit performs a rotation with varying angular velocity comprising a constant part and a superimposed torsional vibration. In extreme cases, the torsional part becomes so large that the bit periodically comes to a complete standstill, during which the drillstring is torqued-up until the bit suddenly rotates again and speeds up to an angular velocity exceeding the topdrive speed. This phenomenon is known as stick-slip, or more precisely, torsional stick-slip. Measurements and simulations have also revealed that the drillstring can sometimes exhibit axial stick-slip motion, especially when the drillstring is hoisted or lowered at a moderate speed. This motion is characterized by large axial speed variations at the lower end of the drillstring and can be observed at the surface as substantial oscillations of the top tension, commonly called the hook load. The observed stick-slip oscillation period is most often close to the period of the lowest natural resonance mode.

Torsional stick-slip has been studied for more than two decades and it is recognized as a major source of problems, such as excessive bit wear, premature tool failures and poor drilling rate. One reason for this is the high peak speeds occurring during in the slip phase. The high rotation speeds in turn lead to secondary effects like extreme axial and lateral accelerations and forces.

A large number of papers and articles have addressed the stick-slip problem. Many papers focus on detecting stick-slip motion and on controlling the oscillations by operational means, such as adding friction reducers to the mud, changing the rotation speed or the weight on bit. Even though these remedies sometimes help, they are either insufficient or they represent a high extra costs.

A few papers also recommend applying smart control of the topdrive to dampen and prevent stick-slip oscillations. In IADC/SPE 18049 it was demonstrated that torque feed-back from a dedicated drillstring torque sensor could effectively cure stick-slip oscillations by adjusting the speed in response to the measured torque variations. In Jansen, J. D et al. "Active Damping of Self-Excited Torsional Vibrations in Oil Well Drillstrings", 1995, Journal of Sound and Vibrations, 179(4), 647-668, it was suggested that the drawback of this approach is the need for a new and direct measurement of the drillstring torque, which is not already available. U.S. Pat. No. 5,117,926 disclosed that measurement as another type of feed-back, based on the motor current (torque) and the speed. This system has been commercially available for many years under the trade mark SOFT TORQUE®. The main disadvantage of this system is that it is a cascade control system using a torque feed-back in series with the stiff speed controller. This increases the risk of instabilities at frequencies higher than the stick-slip frequency, especially if there is a significant (50 ms or more) time delay in the measurements of speed and torque.

The patent application PCT/GB2008/051144 discloses a method for damping stick-slip oscillations, the maximum damping taking place at or near a first or fundamental (i.e. lowest frequency) stick-slip oscillation mode. In developing the present method a further problem to be addressed when the drillstring is extremely long (greater than about 5 km) and the fundamental stick-slip period exceeds about 5 or 6 s has been identified. Even though the method according to this document is able to cure the fundamental stick-slip oscillation mode in such drillstrings, as soon as these oscillations are dampened, the second natural mode tends to become unstable and grow in amplitude until full stick-slip is developed at the higher frequency. In certain simulations it has been found that this second mode has a natural frequency which is approximately three times higher than the fundamental stick-slip frequency. The higher order stick-slip oscillations are characterized by short period and large amplitude cyclic variations of the drive torque. Simulations show that the bit rotation speed also in this case varies between zero and peak speeds exceeding twice the mean speed.

A more recent patent application PCT/GB2009/051618 discloses some improvements of the preceding application, such as inertia compensation term in combination with a slight detuning of the topdrive speed controller. These improvements broaden the absorption band width and enable the topdrive to effectively dampen also the second torsional mode, thus preventing second mode stick-slip from occurring. Another improvement is a method for real-time estimation of the rotational bit speed, based on the dynamic drive torque variations. Field experience and also extensive testing with an advanced simulation model have shown that all of the current systems for damping stick-slip oscillations sometimes fail to solve the stick-slip problem, and especially in very long drillstrings, say >5000 m. All active systems mentioned above have in common that they modify the speed of topdrive in response to a varying torque load. The resulting damping is sometimes but not always sufficiently strong to remove stick-slip oscillations. The systems have also proved to be very sensitive to noise and delay of the control signals i.e. speed and torque so that even a small time delay in order of 50 ms can cause instability to occur at higher frequencies.

The purpose of the disclosed embodiments is to overcome or reduce at least one of the disadvantages of the prior art.

The purpose is achieved according to various embodiments by the features as disclosed in the description below and in the following patent claims.

BRIEF DESCRIPTION OF FIGURES

Below, the description refers to the following drawings, where.

DETAILED DESCRIPTION OF THE DISCLOSED EMBODIMENTS

General Concepts Pertaining to the Embodiments

Figure 1:
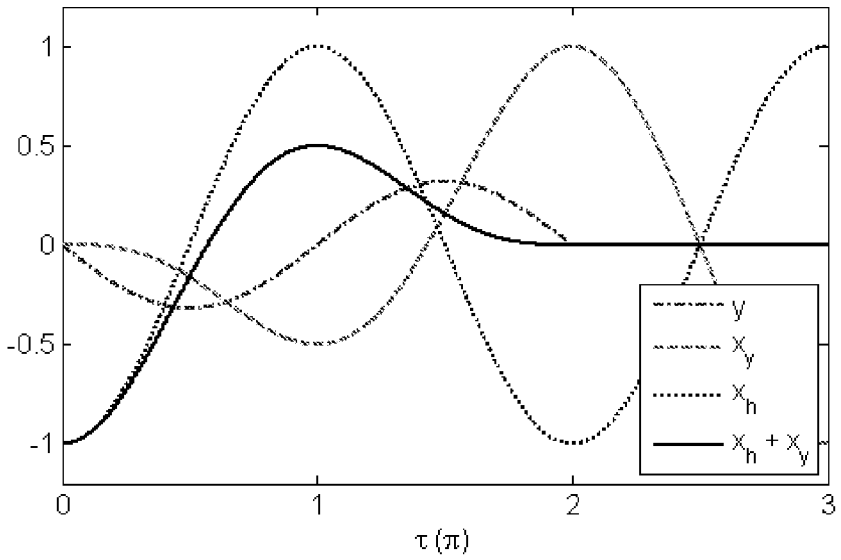
FIG. 1 shows a graph where a harmonic oscillation is cancelled by a one period sine pulse where the abscissa represents normalized time and the ordinate represents normalized rotation speed in accordance with principles described herein.

The embodiments of the present disclosure are based on the insight gained both through field experience and through experience with an advanced simulation model. This model is able to describe simultaneous axial and torsional motion of the drillstring and includes sub-models for the draw works and the topdrive. The experience from both sources shows that even the most advanced stick-slip mitigation tools are not able of curing stick-slip in extremely long drillstrings in deviated wells. However, simulations showed that difficult stick-slip can be removed if the topdrive speed is given a step-like change of the right size and timing. A further investigation revealed that a number of different transient speed variations could remove the stick-slip motion. This approach is fundamentally different in several ways from the systems described above:

First, the transient speed variation is controlled in an open-loop manner, meaning that the rotation speed follows a predetermined curve that is not adjusted in response to the instant torque load.

Second, the current method represents a relatively short duration that is on the order of one stick-slip period while the preceding methods represent continuous adjustment of the rotation speed of "infinite" duration.

Finally, the method is not limited to torsional stick-slip oscillations but applies also to axial stick-slip oscillations.

According to the present disclosure there is provided a method of reducing or avoiding at least axial or torsional oscillations in a drillstring with a bit attached to its lower end and controlled by a hoisting and rotation mechanism attached to its top end, where the controllable variables are vertical and rotational speeds and the response variables are axial tension force and torque, referenced to the top of the drillstring, wherein the method includes the steps of:

i) choosing at least one string oscillation mode to be controlled;

ii) monitoring the controllable variable and response variable relevant for said oscillation mode;

iii) determining the oscillation period of said mode;

iv) estimating from the relevant response variable the dynamic bit speed of said mode;

v) determining a speed pulse capable of generating an oscillation with an amplitude substantially equal to the amplitude of said estimated bit speed; and vi) starting an open-loop controlled speed variation by adding said speed pulse to the operator set speed command when the amplitude of said bit speed estimate exceeds a certain threshold level and the anti-phase of said bit speed estimate matches the phase of the pulse generated oscillation.

It is to be noted that various embodiments of the disclosure are effective in removing the stick-slip oscillations but may not always be effective in preventing stick-slip from re-appearing. In some cases, especially at small to moderate speeds, the system may be unstable because the friction (torque) drops slightly with speed. This means negative differential damping that can cause a small variation to grow exponentially until full stick-slip is developed. Therefore, in some situations it is beneficial to use the current method in combination with a feed-back based damping system, thus acting as an add-on to existing stick-slip mitigation methods. However, since the task for the feed-back system is to prevent rather than remove stick-slip oscillations, the softness or mobility of the speed control can be much reduced. The benefit of that is higher tolerance to signal delay and reduced risk of high frequency instabilities.

To simplify the analysis it is assumed that the drillstring may be treated as a simple harmonic oscillator. This means that the analysis pertains to one natural mode. Subsequently the validity of this assumption is discussed, and the method is generalized to more modes. The analysis below is restricted to the torsional oscillation, but the same formulation applies equally well to the axial drillstring motion. The equation of motion for a torsional pendulum is $$J\frac{d^2\theta}{dt^2} = S(\theta_{td} - \theta) \tag{1}$$

where $\theta$ is the dynamic angular displacement of the lumped inertia, $\theta_{td}$ is the topdrive motion, J is the pendulum inertia, S is the angular spring rate. The natural frequency of the oscillator is given by $\omega=\sqrt{S/J}$. By introducing the non-dimensional (normalized) time variable $\tau=\omega t$ the equation of motion can be simplified to $$\frac{d^2x}{d\tau^2} + x = y \tag{2}$$

Here x denotes the angular motion, for example, the angular displacement $\theta$, angular speed $d\theta/dt$, or angular acceleration $d^2\theta/dt^2$, and y is the corresponding variable for the topdrive. The general homogeneous solution ($y\equiv 0$) is $x_h=a\cdot\cos(\omega t-\phi)$ where the amplitude and the phase angle $\phi$ are arbitrary integration constants. This solution represents an undampened harmonic oscillation.

The differential equation can formally be twice integrated to give a formal general particular solution as an integral equation $$x=x_0+\int_0^\tau(\dot{x}_0+\int_0^\tau(y-x)d\tau)d\tau \tag{3}$$

where $x_0$ and $\dot{x}_0$ represents start values for x and its time derivative. This formula is also suited for direct numerical integration to find a solution from any predefined pulse y.

A simple but physically relevant particular solution is the constant: $x=y=x_0$. This represents a smooth, steady state rotation without oscillations. For convenience, the constant component of the particular solution is omitted in the analysis below.

It can be seen that there exist an infinite number of other functions y that may cancel an initial oscillation $x_h$. An important sub-class of such functions are windowed functions that are zero outside a finite time interval and formally written as $$y=f(\tau)\cdot(H(\tau)-H(\tau-\tau_y)) \tag{3}$$

Here f is a general pulse function and H is the so-called Heaviside step function, defined as zero for negative arguments, ½ A for zero and unity for positive arguments. The last factor represents a window that is unity for $0<\tau<\tau_y$ and zero outside the window. Without loss of generality we have here assumed that the window starts at zero time. It is easily verified that a phase shifted and sign flipped pulse $$y_k(\tau)=(-1)^k y(\tau+k\pi) \tag{4}$$

is also a solution pulse if k is an integer. This formula may be used to construct a new solutions consisting of a weighted sum of the primary and shifted pulses:

$$y = \sum_{k=0}^{k_{max}} a_k\, y_k(\tau) \tag{5}$$

Here $a_k$ are amplitudes, normalized so that their sum equals unity. It is easily verified from the general homogeneous solution that $dx_h(\tau)/d\tau=x_h(\tau-\pi/2)$. This may be used for generating new but differently shaped solution pulses by:

$$y^{(d)} = \frac{d}{d\tau}y\left(\tau+\frac{\pi}{2}\right) \tag{6}$$

$$y^{(i)} = \int y\left(\tau-\frac{\pi}{2}\right)d\tau = -\int y\left(\tau+\frac{\pi}{2}\right)d\tau \tag{7}$$

The super scripts are here defined as a combination of integration/differentiation and phase shifting.

As a non-exclusive example, the following primary pulse is discussed:

$$y = -\frac{\sin(\tau)}{\pi}\cdot(H(\tau)-H(\tau-2\pi)) \tag{8}$$

First, assume that there is no oscillation before the start of the pulse, meaning that $x_0=\dot{x}_0=0$. It can be seen that the particular solution with this pulse can be written as $$x_y = \frac{\tau\cos(\tau)-\sin(\tau)}{2\pi}(H(\tau)-H(\tau-2\pi)) + \cos(\tau)H(\tau-2\pi) \tag{9}$$

It is easily verified that this solution reduces to $\cos(\tau)$ when $\tau>2\pi$. Because the system is linear the example pulse is able to cancel or nullify a pre-pulse oscillation $x_h=\cos(\tau+\pi)=-\cos(\tau)$ that has the same amplitude but of opposite phase to the generated oscillation. The various functions are plotted in FIG. 1 to illustrate the cancellation process.

Figure 2:
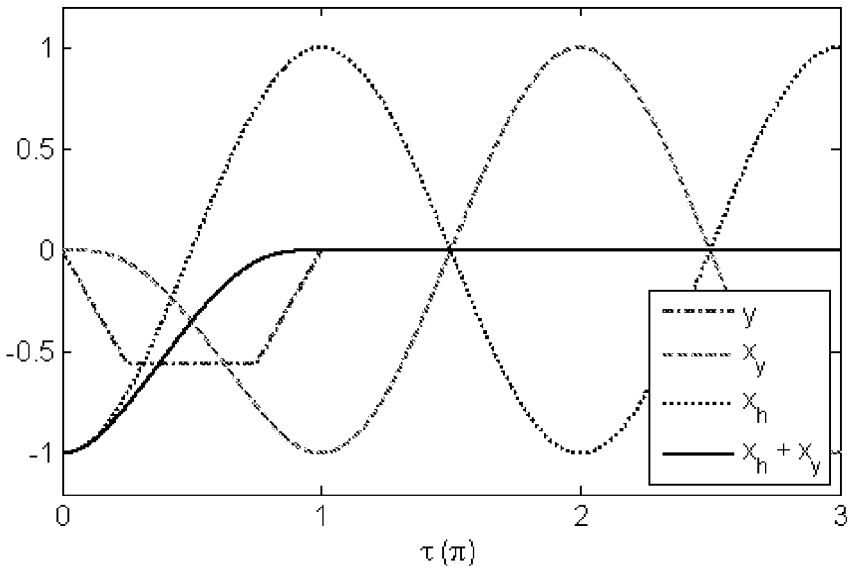
FIG. 2 shows a graph where a harmonic oscillation is cancelled by a half period trapezoidal pulse where the abscissa represents normalized time and the ordinate represents normalized rotation speed in accordance with principles described herein.

The bipolar sinusoidal pulse is just one of infinite number of possible cancellation functions. Another example is the unipolar and trapeze shaped function shown as the dashed-dotted curve in FIG. 2. In this case the solutions are found numerically, although analytic solutions exist also for this pulse choice. Both pulses generate an oscillation of unit amplitude and zero phase. Zero phase is a consequence of the fact that the generated oscillation has a peak at multiples of $2\pi$ and can be represented by a pure cosine term without phase shift. An arbitrary pulse can have a different amplitude and a non-zero phase. A non-singular pulse, which is here defined as a pulse generating oscillation of finite amplitude, can be normalized to give a unit oscillation amplitude. It is also convenient to define a pulse phase as the phase of its generated oscillation, referenced to start of the pulse. In the two examples above the pulse phases are zero, meaning that the generated oscillation has a peak one period after start of the pulse.

Figure 3:
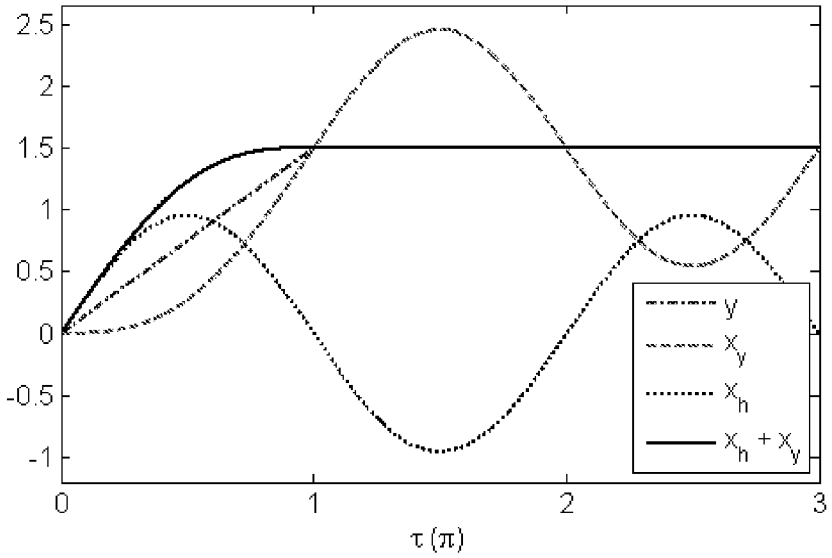
FIG. 3 shows a graph where the speed is increased and a harmonic oscillation is cancelled by a half period linear ramp, where the abscissa represents normalized time and the ordinate represents normalized rotation speed in accordance with principles described herein.

The two first examples also have in common that they do not change the mean speed. It is possible to construct generalized pulses that also changes mean speed. It can be argued that these are not a pulse in normal sense but a kind of smoothed step functions. Nevertheless, as long as their time derivative vanishes outside the window, they are termed speed changing pulses, for convenience. An example of such a speed changing pulse is shown in FIG. 3. Here the speed is increased linearly over half an oscillation period. This speed change can be regarded as a square acceleration pulse (not visualized in the Figure) creating a speed change of 1½ while creating an oscillation of unit amplitude. Note that this time the generated oscillation has its peak at the normalized time $\tau=3\pi/2$. The pulse phase is therefore, per definition, $3\pi/2$ or $-\pi/2$. The optimal timing of this pulse relative to the bit speed is therefore different than for the two preceding ones.

In general, the phase of a (non-singular) pulse can be determined explicitly as the argument (phase) of the following complex Fourier amplitude:

$$c = \frac{1}{\pi}\int_{\tau_1}^{\tau_1+2\pi} x_y e^{-i\tau}\, d\tau \tag{10}$$

Here the lower integration limit represents the upper end of the pulse window.

Figure 4:
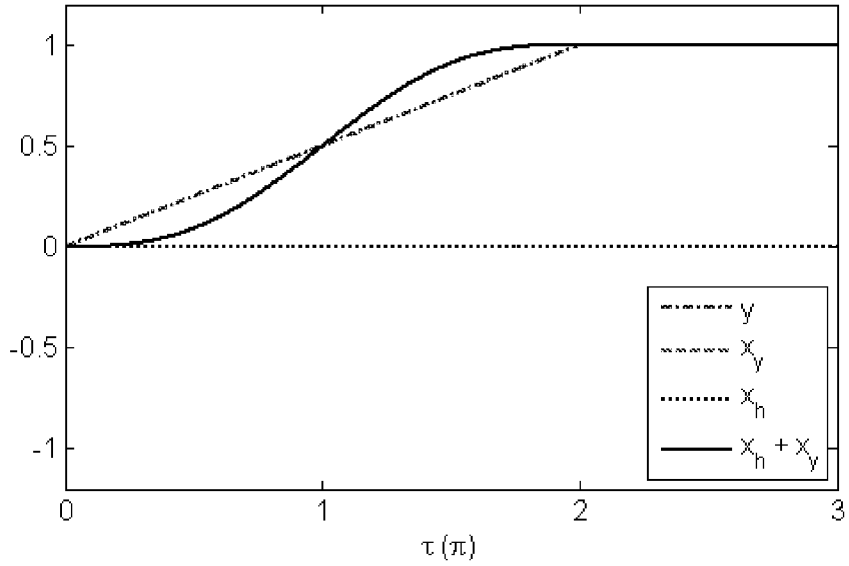
FIG. 4 shows a graph where the speed is increased linearly without generating oscillations, where the abscissa represents normalized time and the ordinate represents normalized rotation speed in accordance with principles described herein.

The $4^{th}$ example, shown in FIG. 4, is a singular pulse creating no oscillations but a unit speed change. In this case zero initial oscillation is chosen, illustrating the fact that the speed can be changed without creating any oscillations. The imposed speed is simply the integral of a rectangular acceleration pulse giving a unit speed change during a time interval of one oscillation period. Because the initial oscillation is zero the dash curve matches and is hidden under the solid curve.

These examples are only a few of an infinite number of possible non-singular and singular pulses. A singular pulse can be regarded as a linear combination of two or more non-singular pulses such that the vector sum of all amplitudes is zero. A special class of singular pulses is constructed from an arbitrary pulse by splitting it into the sum of half its original pulse and the other half delayed by half oscillation period. That is, $$\eta=\tfrac{1}{2}y(\tau)+\tfrac{1}{2}y(\tau-\pi) \tag{11}$$

is a singular pulse for any original pulse y. This can be deduced from the shift rule (4) which implies that the generated oscillation from the second term equals that of the first term with a sign shift.

The theory above describes a way to generate a controlled harmonic oscillation able to cancel a known unwanted oscillation. However, it remains to determine the amplitude and phase of this unwanted oscillation, because the rotational speed at the bottom of the string is not directly observable. From the basic differential equation of motion (1) it is clear that the right hand term represents the twist torque of the harmonic oscillator. Before the pulse is started, this term is represented by the time integral of the speed. Expressed in normalized variables, the torque equals the integral of the speed $x_h$, or simply $x_h(\tau-\pi/2)$. Hence it is possible to determine the amplitude and phase of the non-observable speed from the oscillator spring torque.

The studied harmonic oscillator is a simple mathematical approximation for a drillstring. As pointed out by Kyllingstad and Nessjoen in the SPE paper "Hardware-In-the-Loop Simulations Used as a Cost Efficient Tool for Developing an Advanced Stick-Slip Prevention System" (SPE 128223, February 2010) a drillstring is more accurately described as a continuum or as a wave guide possessing a series of natural modes. This paper presents formulas valid for relatively simple drill strings consisting of one uniform drill pipe section and a lumped bottom hole assembly inertia. Here, it is taken a step further, and a brief outline of a method that applies also for string geometries of greater complexity is given.

Assume that the drillstring consists of m uniform sections and that the oscillation state of the string is described of 2 m complex wave amplitudes, representing one downwards and one upwards propagating (mono frequency) wave for each section. Continuity requirements of speed and torque across the boundaries result in 2 m−2 internal boundary conditions and 2 end conditions that together form a 2 m×2 m matrix equation. Details of deriving the matrix equation can be found in a paper by Halsey et al: "Drillstring Torsional Vibrations: Comparison between Theory and Experiment on a Full-Scale Research Drilling Rig", (SPE 15564, 1989). This matrix equation can formally written as $$Z\cdot\Omega=T \tag{12}$$

Here the system matrix Z is a complex, frequency dependent impedance matrix, Ω contains all the complex rotational speed amplitudes, and the right hand side is a vector representing external torque input. The formal solution of the matrix equation is just $$\Omega=Z^{-1}T \tag{13}$$

A useful response function is the top torque divided by the input torque at the lower end. This non-dimensional torque transfer function can be expressed as $$H_T = \frac{\zeta_1\cdot(\Omega_1-\Omega_2)}{T_{2m}} \tag{14}$$

where $\zeta_1$ is the so-called characteristic impedance of the upper drill string section and the two terms inside the parenthesis are rotation speed amplitudes of respective upwards and downwards propagating waves. If a small but finite damping is included, be it either in the topdrive or along the string, the above response function will be a function with sharp peaks representing natural resonance frequencies of the system. If damping is neglected, the system matrix becomes singular (with zero determinant) at the natural frequencies.

Another useful response function is the dynamic compliance defined as the ratio of total twist angle to the top torque. It can be mathematically written as $$C = \frac{\Omega_{2m}e^{-ikl}-\Omega_{2m-1}e^{ikl}}{i\omega\zeta_1\cdot(\Omega_1-\Omega_2)} \tag{15}$$

Figure 5:
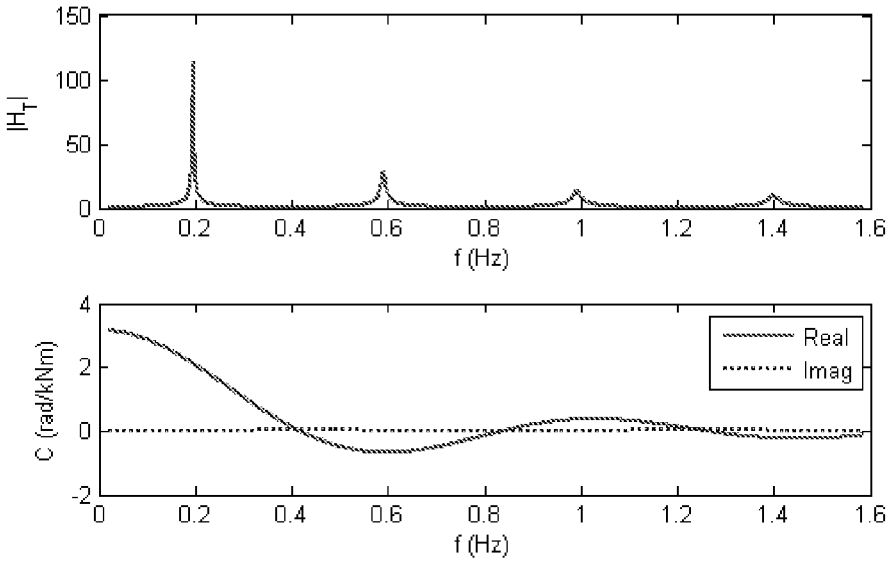
FIG. 5 shows graphs of calculated torque and compliance response function in a 3200 m long drillstring where the abscissa represents oscillation frequency in cycle per seconds and the ordinate of the upper subplot represent normalized top torque to input bit torque ratio, and the ordinate of the lower subplot represents dynamic torsional compliance in radians per kNm in accordance with principles described herein.

Here $i=\sqrt{-1}$ is the imaginary unit, w is the angular frequency, $k=c/\omega$ is the wave number, c being the wave propagation speed, and l is the total string length. The two speed amplitudes in the numerator are respective downwards and upwards propagating wave amplitudes. As an example, the magnitude of the torque transfer function from Equation 14 is plotted versus frequency in the upper subplot of FIG. 5, and the real and imaginary parts of the dynamic compliance of a 3200 m long string, using Equation 15, are plotted versus frequency in the lower subplot of FIG. 5. The chosen frequency span of 1.6 Hz covers 4 peaks representing string resonance frequencies. In contrast to the peaky torque transfer function, the compliance shown in the lower subplot is a slowly changing function of frequency. It is approximately equal to the static (low frequency) compliance times a dynamic factor sin(k)/kl accounting for a finite wave length to string length ratio. The imaginary part of C, shown as a dotted line, is lower than the real part.

When the dynamic compliance is determined, the bit speed can be calculated from top torque. One possible way to do this is to multiply the Fourier transform of the torque by the mobility function iωC and apply the inverse Fourier transform to the product. A more practical method, which requires less computer power, is described by Kyllingstad and Nessjøen in the referenced paper. Their method picks one dominating frequency only, typically the stick-slip frequency, and applies numerical integration and a band-pass filtering of the torque signal to achieve a bit speed estimate. The method uses the static drillstring compliance, corrected for the dynamic factor sin(kl)/kl.

A third method to find the dynamic bit speed is described by the algorithm below. It assumes that the angular oscillation period $t_\omega 2\pi/\omega$ and the complex compliance C at this frequency are known quantities, found as explained above.

a) Calculate the complex torque amplitude by the Fourier integral $$\tilde{T} = \frac{2}{t_\omega}\int_{t-t_\omega}^{t} T(t')e^{i\omega(t-t')}\,dt' \tag{16a}$$

b) Estimate the corresponding complex bit speed amplitude by $$\tilde{\Omega}_b = -i\omega C\tilde{T} \tag{16b}$$

This function determines the amplitude $|\tilde{\Omega}_b|$ and the phase $\arg(\tilde{\Omega}_b)$ of the estimated bit speed.

c) Estimate the bit speed as the sum of measured topdrive speed and the real part of this complex amplitude $$\Omega_{be} = \Omega_d + Re(\tilde{\Omega}_b) \tag{16c}$$

The steps above are calculated for every time step, and the Fourier integral can be realized in a computer as the difference between an accumulated integral (running from time zero) minus a time lagged value of the same integral, delayed by one oscillation period. The accuracy of the bit speed estimate can be improved, especially during the initial twist-up of the string, if a linear trend line representing a slowly varying mean torque is subtracted from the total torque before integration. Furthermore, it is possible to smooth the instantaneous estimates of amplitude and phase by applying a low pass filter also utilizing the preceding measurements. To avoid delay of the phase estimate, the elapsed time is used, for instance by using the following $1^{st}$ order recursive filter: $\sigma_{s,i}=(\sigma_{s,i-1}+\omega\Delta t)(1-b)+\sigma_{s,i-1}+b\sigma_i$. Here $\sigma_{s,i}$ represents the smoothed phase estimate, the subscript i represents the most recent or last sample, Δt denotes the time increment and b is a positive smoothing parameter, normally much smaller than unity. Another way to smooth the bit estimate is to increase the backwards integral interval, from one oscillation period to two or more periods.

The use of one complex Fourier integral in step "a" (above) is for convenience and for minimizing number of equations. It can be substituted by two real sine and cosine Fourier integrals.

The above algorithm for estimating bit speed is new and offers significant advantages over the estimation method described by the referenced paper by Kyllingstad and Nessjoen. First, it is more responsive because it finds the amplitude directly from a time limited Fourier integral and avoids slow, higher order band-pass filters. Second, the method suppresses the higher harmonic components more effectively. Finally, it uses a theoretical string compliance that is more accurate, especially for complex strings having many sections.

It is shown that a drillstring differs from a harmonic oscillator because of the substantial string length/wave length ratio. Another difference is the friction between the string and the wellbore and the bit torque. Both the well bore friction and the bit torque are highly non-linear processes that actually represent the driving mechanisms for stick-slip oscillations. During the sticking phase the lower drillstring end is more or less fixed, meaning that the rotation speed is zero and independent of torque. In contrast, the bit torque and well bore friction are nearly constant and therefore represents a dynamically free lower end during the slip phase. Theory predicts and observations have confirmed that the lowest stick-slip period is slightly longer than the lowest natural mode for a completely free lower end. Consequently, the period increases when the mean speed decreases and the duration of sticking phase increases. For purely periodic stick-slip oscillations the bit speed and the top torque may be characterized by Fourier series of harmonic frequencies, those frequencies being integer multiples of the inverse stick-slip period. These frequencies should not be confused with the natural frequencies which, per definition, are the natural frequencies of a fixed-free drillstring with no or a low linear friction. A higher mean speed tends to shorten the slip phase and reduces the relative magnitude of the higher harmonics. For speeds above a certain critical rotation speed the sticking phase ceases and the oscillations transform into free damped oscillations of the lowest natural modes. This critical speed tends to increase with growing drillstring length and increased friction, and it can reach levels beyond reach even for moderate string lengths.

To test if the above method derived for a simple harmonic oscillator is applicable for cancelling torsional stick-slip oscillation in a drillstring, an advanced mathematical model is used for simulating the drillstring as realistically as possible. For details of the model, see the referenced paper by Kyllingstad and Nessjoen. Simulation results, which are discussed in more detail in the section below, justify that method described for a simple harmonic oscillator also applies for long drillstrings.

One of the simulation results below also shows that the method is not limited to cancelling just one oscillation mode at a time, but can be used for simultaneous cancelling of both $1^{st}$ and $2^{nd}$ torsional mode oscillations. Other simulation results, not included here, show that the method also applies to cancel axial stick-slip oscillation in a string. The method is equally suitable for use on land and offshore based drill rigs, where a drill motor is either electrically or hydraulically driven.

The method may further include determining the period of said mode theoretically from the drillstring geometry by solving the system of boundary condition equations for a series of possible oscillation frequencies and finding the peak in the corresponding response spectrum.

The method may further include determining an estimate of said bit speed by the following steps:

a) finding the dynamic string compliance by applying formula (15) for the determined mode frequency;
b) finding the dynamic response variation by subtracting the mean value or a more general trend line from the raw response signal;
c) finding a complex amplitude of said dynamic response by calculation a Fourier integral over an integer number of periods back in time;
d) determining the complex amplitude of said dynamic bit speed by multiplying said complex response amplitude by the calculated dynamic compliance and by the product of the imaginary unit and the angular frequency of said mode; and
e) finding the real speed, amplitude and phase of said complex bit speed amplitude as respective the real part, the magnitude and the argument of said complex amplitude.

The method according to the present disclosure will overcome the weaknesses of current stick-slip damping systems and other kinds of smart control of the topdrive. The method makes it possible to remove or substantially reduce stick-slip oscillations over a wider range of conditions. In contrast to the previous systems, which all represent a continuous closed-loop control of the topdrive speed in response to the instantaneous torque load, the proposed method uses an open-loop controlled speed variation that shall remove or substantially reduce unwanted oscillations during a short period.

Concepts Related to at Least One Specific Embodiment

Figure 6:
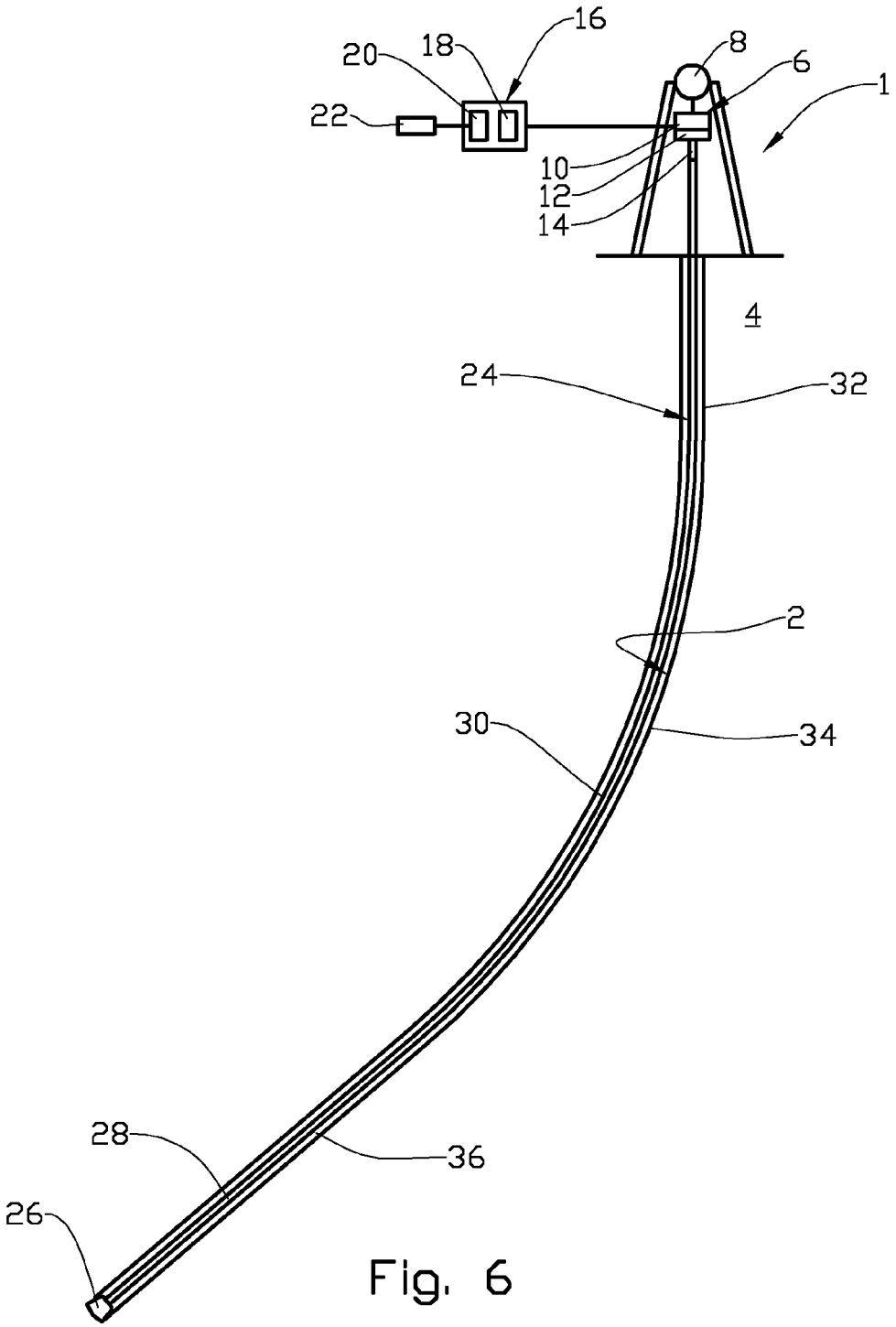
FIG. 6 shows a schematic drawing of a drill rig and a drillstring that is controlled in accordance with principles described herein.

On the drawings, and particularly in FIG. 6, the reference numeral 1 denotes a drill rig from where a borehole 2 is drilled into the ground 4. The drill rig 1 includes a rotation mechanism 6 in the form of a topdrive that is movable in the vertical direction by use of a hoisting mechanism 8 in the form of draw works.

The topdrive 6 includes an electric motor 10, a gear 12 and an output shaft 14. The motor 10 is connected to a drive 16 that includes power circuits 18 that are controlled by a speed controller 20. The set speed and speed controller parameters are governed by a Programmable Logic Controller (PLC) 22 that may also be included in the drive 16. A drillstring 24 is connected to the output shaft 14 of the topdrive 6 and has a drill bit 26. In this particular embodiment the drillstring 24 consists of heavy weight drillpipe 28 at its lower part and normal drillpipe 30 for the rest of the drillstring 24. The bit 26 is working at the bottom of the borehole 2 that has an upper vertical portion 32, a curved so-called build-up portion 34, and a deviated portion 36. It should be noted that FIG. 6 is not drawn to scale.

Simulations using the simulation program mentioned in the general part of the description, have shown that the methods for cancelling oscillations in a harmonic oscillator also apply for cancelling stick-slip in drillstrings 24. The chosen test case is a 3200 m long drillstring 24 placed in a highly deviated borehole 2. The well bore trajectory can be described by three sections. The first one is vertical from top to 300 m, the second is a curved one (so-called build-up section) from 300 to 1500 m and the third one is a straight, 75 degree inclined section reaching to the end of the drillstring 24.

The simulations have been carried out with a standard speed controller 20 for the topdrive 6. To improve the response for rapid changes in the set speed an acceleration feed-forward term is added to the PI terms. In the linear mode, when capacity limits are avoided, the topdrive 6 torque can thus be expressed by:

$$T_d = P\cdot(\Omega_{set} - \Omega_d) + I\int(\Omega_{set} - \Omega_d)dt + J_d\frac{d\Omega_{set}}{dt} \tag{17}$$

Here $\Omega_{set}$ is the set speed, $\Omega_d$ is the topdrive 6 rotation speed, P is the proportionality gain, I, is the integral gain and $J_d$ is the estimated mechanical inertia of the topdrive 6, referenced to the output shaft 14. The dynamic part of $\Omega_d$ represents the scaled version of general topdrive 6 speed pulse y used in the theory above. In the simulation string torque $T_s$ is taken directly for the model (as if there is a dedicated torque meter at the top of the string). (If direct measurements are not available, the string torque can be derived from the motor based topdrive torque by correcting for gear losses and inertia: $T_s=\eta T_d-J_d\cdot d\Omega_d/dt$ where $\eta$ is the gear transmission efficiency.)

Figure 7:
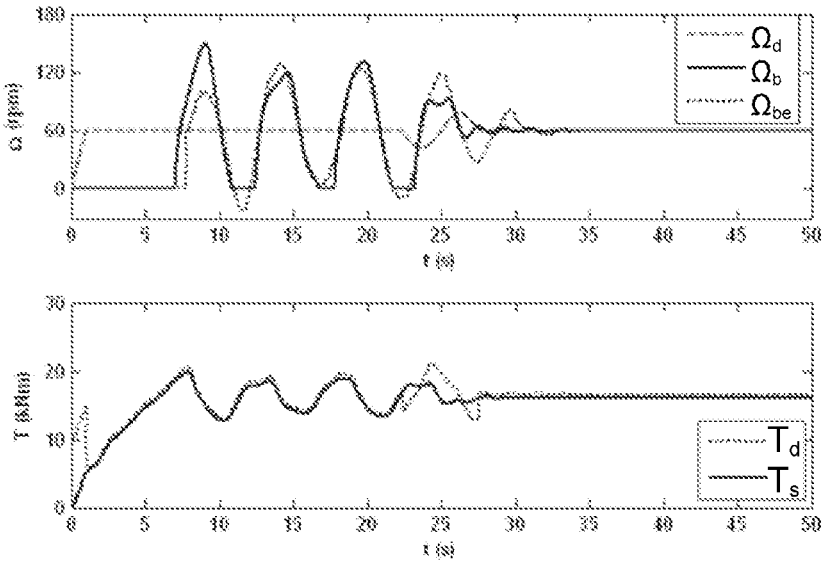
FIG. 7 shows a graph from a simulation of cancelling torsional stick-slip in a 3200 m long drillstring where the abscissa represents simulation time in seconds and the ordinate of the upper subplot represent simulation speed, and the ordinate of the lower subplot represents the torque in accordance with principles described herein.

The simulation results are shown in FIG. 7. The upper subplot shows the simulated values of topdrive 6 speed $\Omega_d$ and bit speed $\Omega_b$ of bit 26, and also shows the estimated bit speed $\Omega_{be}$ versus time t. The lower subplot shows drive torque $T_d$ from motors 10 and top drillstring 24 torque $T_s$ for the same period of 50 s. The difference between the two torque curves comes from inertia and gear losses. The estimated bit speed $\Omega_{be}$ is found as the sum of topdrive speed and the dynamic speed found from the top string torque using the new estimation algorithm described in the general description above. An extra logic keeps the speed zero during initial twist-up, until the top torque reaches its first maximum. These simulations are worked out with the drillstring 24 consisting of (from lower end up) a bit 26, 200 m of 5 inch heavy weight (thick walled) drillpipes 28 and 3000 m of ordinary 5 inch drillpipes 30. The linear method, described in the general description, applied for this particular string predicts a dynamic compliance 2.14 rad/kNm at the lowest resonance of period of 5.16 s. In comparison, the simulated stick-slip period at a mean rotation speed of 60 rpm is about 5.36 s. This difference is consistent with the fact that the sticking phase duration is about 1.5 s, or 27% of the full stick-slip period. The optimal amplitude of the chosen bipolar sinusoidal pulse (having a period of 5.16 s) is 17.2 rpm. This amplitude is lower but in the same order as the estimated bit speed amplitude divided by $\pi$: 69.8 rpm/$\pi$=22.2 rpm. The optimal start time for the pulse is 22.42 s, which is 0.17 s beyond the last minimum of the estimated bit speed. This time lag represents 12 degrees phase delay relatively to the prediction from the simple harmonic theory. Despite these relatively modest mismatches, the simulation results justify that the method derived for a simple harmonic oscillator applies also to a drillstring; even though a drillstring is a more complex dynamic system. The fairly good match between simulated bit rotation speed $\Omega_b$ and the torque based estimate $\Omega_{be}$ also is a validation of the new estimation method. The fact that the estimated speed sometimes swings below zero speed is not unexpected, bearing in mind that the stick-slip oscillations are not purely periodic and have substantial sticking time intervals. Backwards rotation is not supported by the simulations so a visualization of the estimated bit speed should include a clipping filter that removes the negative speeds.

For practical purposes the optimal timing and amplitude of the cancellation pulse is calculated by the PLC 22 that is programmed to undertake such calculations based on measurements as explained above. Signal values for building a correct pulse in the power circuits for the motor 10 is transmitted to the speed controller 20.

Figure 8:
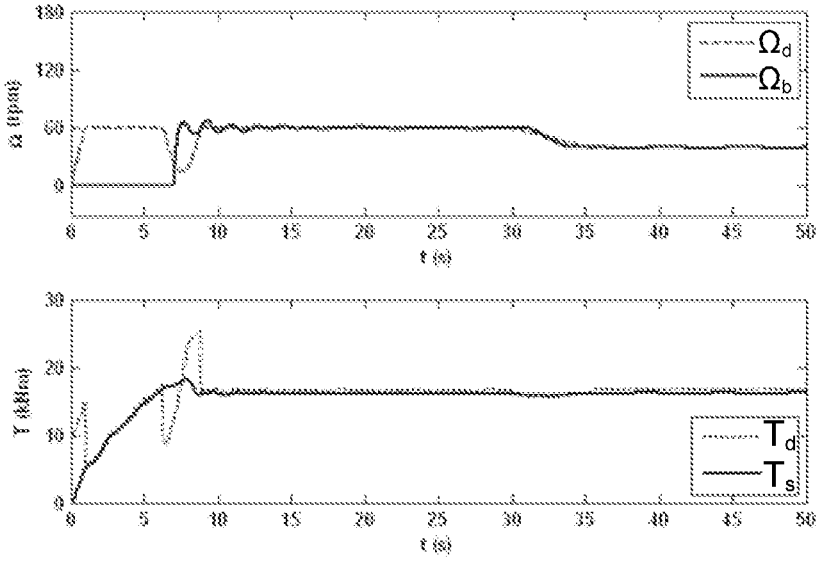
FIG. 8 shows a graph from simulation of canceling torsional stick-slip in a 7500 m long drillstring where the abscissa represents simulation time in seconds and the ordinate of the upper subplot represent simulation speed, and the ordinate of the lower subplot represents the torque in accordance with principles described herein.

In another example, shown in FIG. 8, the cancellation pulse is started before the bit has started to rotate and the torque has reached its first maximum. With proper timing of this pulse, the stick-slip motion is hindered before it has started. In this case a negative single sided pulse (of a half period duration) is used because, at least in some embodiments, this pulse almost entirely removes the over-swing of the bit speed. In contrast to the previous example there is no oscillation of torque that can give a reasonable estimate of the bit speed, which is therefore omitted in the plot. However, if one knows the mean torque and the oscillation period before start of rotation, one can use the crossing of this mean torque as a triggering event for the pulse. FIG. 8 also shows an example of changing the speed in a controlled way leaving no residual oscillations after the adjustment. In this particular case the speed is reduced from 60 to 40 rpm through a linear ramp of the speed. We see that this speed change, which takes place over one period (5.16 s), is successful in that it creates no new oscillations. A closer examination of the simulation results shows that there is a small residual oscillation of about 0.8 rpm amplitude, and this tends to grow slightly towards end of simulation. This illustrates that smooth rotation at low speed is unstable and that an active damping system is needed, in this example, to prevent full stick-slip oscillation from developing.

The examples above are strong justifications that the theory for cancelling oscillations in a simple oscillator applies well for a drillstring 24, at least when the drillstring 24 is not extremely long.

Figure 9:
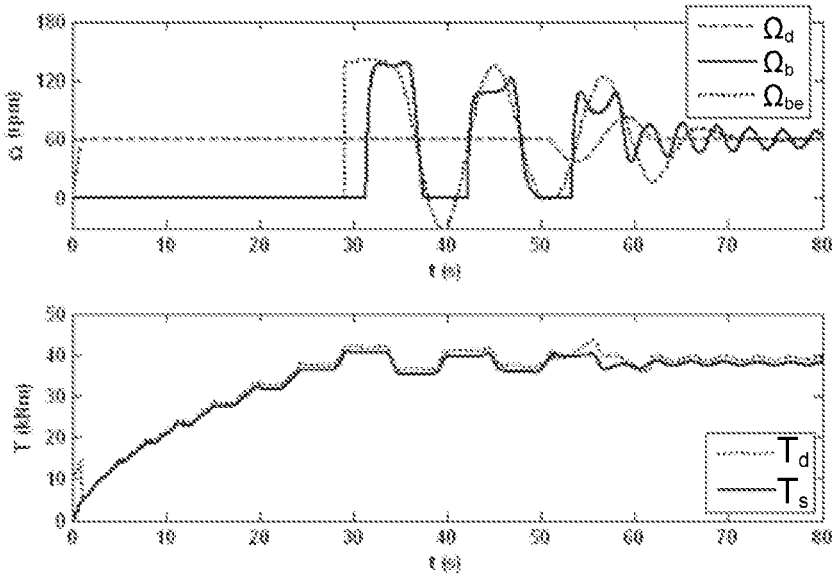
FIG. 9 shows a graph from simulation of cancelling torsional stick-slip and second mode oscillations in a 7500 m long drillstring where the abscissa represents simulation time in seconds and the ordinate of the upper subplot represent simulation speed, and the ordinate of the lower subplot represents the torque in accordance with principles described herein.

Simulations with a 7500 m long drillstring 24 show that that the cancelling pulse method applies also for much longer drillstrings and even for extremely long drillstrings, which represent the most difficult cases for avoiding stick slip. Reference is made to FIG. 9 showing the simulation results when applying a cancellation pulse to a 7500 long drillstring 24 in a highly deviated at 80 degrees inclination from 1500 m to well bottom. The theoretical torsional pendulum period of this string is 10.56 s, again slightly lower than the observed stick-slip period of 10.8 s. The dynamic compliance at this frequency is 4.94 rad/kNm. This value is used for calculating the bit rotation speed $\Omega_{be}$. The amplitude of this estimate varies slightly with time and is about 63 rpm at 50.5 s when the anti-phase is zero. These values are in fairly good agreement with the optimal pulse amplitude and time of respective 22.9 rpm (=71.9 rpm/$\pi$) and 51.1 s. In some other simulation results, not included here, substituting the optimal values by the amplitude and phase from the bit speed estimate show that especially the time mismatch of 0.5 s (17 degree) is large enough to make the pulse method inefficient in cancelling the stick-slip, except for a very short while. This strong requirement for almost perfect amplitude and timing of the canceling pulse is challenging but not totally unexpected. The rotation speed of 60 rpm is below the natural stability limit of this long string. Additional simulations (not shown here) with the same long string but with a higher speeds and/or with an active damping system included show that the pulse cancelation method does work and with a larger error tolerance of non-perfect amplitude and timing of the cancellation pulse.

A comment to the last simulation results in FIG. 9. It is clear that there are some residual oscillations left after the stick-slip is removed. These oscillations are identified $2^{nd}$ mode vibrations because the period is very close to the theoretical $2^{nd}$ mode period of 3.52 s. However, in this case there is sufficient damping to make these oscillations fade away. Simulations have shown that these vibrations may be canceled simultaneously by adding a pulse component of optimal amplitude and phase to the first pulse designed to cancel the lowest oscillation mode only.

The method for cancelling torsional stick-slip oscillations may be summarized by the following algorithm.

i. Determine the oscillation period and the corresponding angular frequency, either theoretically from a description of the drillstring 24 geometry, or empirically from the observed variations of torque or rotation speed.
ii. Continuously measure the speed and torque in the top of the drillstring 24. The latter can either be measured directly, from a dedicated torque sensor (not shown) between the topdrive 6 and the drillstring 24, or indirectly from the motor 10 drive torque corrected for gear loss and inertia effects.
iii. Estimate the bit speed amplitude and phase from the measured torque by one of the algorithms given in the general description.
iv. Select a cancellation pulse form and scale it so that its generated oscillation amplitude matches the estimated bit speed amplitude.
v. If the bit speed amplitude exceeds a certain level, for instance 50 percent of the mean speed, then arm the trigger and wait for an optimal time to start the cancellation pulse.
vi. Start the scaled cancellation amplitude as an addition to the constant set speed when the phase of estimated bit speed amplitude matches or exceeds the anti-phase of the pulse generated oscillation by a certain phase shift.

A simpler algorithm can be used when the purpose is to change the speed permanently without creating a new oscillation.

i. Select a singular speed changing acceleration pulse being a linear combination of non-singular pulses such that their vector sum of generated oscillation is zero.
ii. Start the pulse whenever a speed change is desired.

The above discussion is meant to be illustrative of various embodiments of the present invention. Numerous variations and modifications will become apparent to those skilled in the art once the above disclosure is fully appreciated. It is intended that the following claims be interpreted to embrace all such variations and modifications.

The invention claimed is:

1. A method for reducing or avoiding at least an axial or a torsional oscillation mode in a drillstring with a bit attached to its lower end and controlled by a hoisting and rotation mechanism attached to its top end, wherein available controllable variables are a vertical speed and a rotational speeds and available response variables are an axial tension force and a torque, wherein the available controllable variables and available response variables are referenced to the top end of the drillstring, the method comprising:

choosing at least one oscillation mode to be controlled from among at least an axial or a torsional oscillation mode;

choosing a selected controllable variable from among the available controllable variables and a selected response variable from among the available response variables; wherein these two selected variables are relevant for the oscillation mode monitoring the selected controllable variable and the selected response variable;

determining oscillation period of the oscillation mode;

evaluating from the selected response variable a dynamic bit speed of the oscillation mode;

determining a speed pulse, defined as a time limited variation of the selected controllable variable, capable of generating a generated oscillation with an amplitude substantially equal to an amplitude of the dynamic bit speed; and starting an open-loop controlled speed variation by adding the speed pulse to an operator set speed command when the amplitude of the dynamic bit speed exceeds a certain threshold level and an anti-phase of the dynamic bit speed matches a phase of the pulse generated oscillation.

2. The method of claim 1, wherein the oscillation period of the oscillation mode is determined theoretically from geometry of the drill-string by solving a system of boundary condition equations for a series of possible oscillation frequencies and finding a peak in the corresponding response spectrum.

3. The method of claim 1 further comprising:

finding a dynamic string compliance, defined as the ratio of total twist angle of the drillstring to the torque, for angular frequency of the oscillation mode;

finding a complex response amplitude of the selected response variable by calculation of a Fourier integral of the selected response variable over an integer number of periods back in time;

determining complex bit speed amplitude of the dynamic bit speed by multiplying the complex response amplitude by the dynamic string compliance and by the product of the negative value of an imaginary unit and the angular frequency of the oscillation mode;

finding the amplitude and a phase of the dynamic bit speed as respective magnitude and phase of the complex bit speed amplitude, and finding an estimated bit speed as the sum of the selected controllable variable and the real part of the complex bit speed amplitude.

4. The method of claim 1 further comprising:

starting a feed-back based second speed variation that is added to the operator set speed command or is added to the operator set speed command and the speed pulse.

5. The method of claim 1 wherein the operator set speed command is a rotational speed; and wherein the method further comprises:

rotating the drillstring according to the operator set speed command after the step of starting an open-loop controlled speed variation.

6. A system for reducing or avoiding at least an axial or a torsional oscillation mode in a drillstring, the system comprising:

a drive operable to:

choose at least one oscillation mode to be controlled from among at least an axial or a torsional oscillation mode;

monitor a relevant controllable variable and a relevant response variable for the oscillation mode, wherein the relevant controllable variables is axial speed or rotational speeds, and the relevant response variables is axial tension force or torque;

determine oscillation period of the oscillation mode;

evaluating from the relevant response variable a dynamic bit speed of the oscillation mode;

determine a speed pulse, defined as a time limited variation of a surface speed, capable of generating a pulse generated oscillation with an amplitude substantially equal to an amplitude of the dynamic bit speed; and start an open-loop controlled speed variation by adding the speed pulse to an operator set speed command when the amplitude of the dynamic bit speed exceeds a certain threshold level and an anti-phase of the dynamic bit speed estimate matches a phase of the pulse generated oscillation.

7. The system of claim 6, further comprising:

a rotation mechanism coupled between the drive and the drillstring, the rotation mechanism operable to rotate the drillstring within a borehole in response to a signal from the drive.

8. The system of claim 7, wherein the rotation mechanism is a top drive.

9. The system of claim 6, wherein the drive comprises a programmable controller that controls a set speed and a speed controller parameter.

10. The system of claim 6, wherein the drillstring comprises a first portion and a second portion; wherein the first portion includes drillpipe having heavier weight or thicker wall than drillpipe of the second portion.

11. The system of claim 10 wherein the drillstring comprises a lower end; and wherein the first portion includes the lower end, and wherein length of the first portion is less than 10 percent of length of the second portion.

12. The system of claim 6, wherein the drillstring comprises a total length up to 7500 m.

13. A system for reducing or avoiding at least an axial or a torsional oscillation mode in a drillstring, the system comprising:

a drive configured to:

choose at least one drillstring oscillation mode to be controlled;

monitor a controllable speed variable and a response variable relevant for the oscillation mode;

determine oscillation period of the oscillation mode;

calculate from the response variable a dynamic bit speed of the oscillation mode;

determine a speed change, capable of generating an oscillation with an amplitude substantially equal to the amplitude of the dynamic bit speed; and start a first adjustment to the controllable speed variable by using open-loop control to add the speed change to an operator set speed during a control period on the order of the oscillation period.

14. The system of claim 13 wherein:

the controllable speed variable is a vertical speed, and the response variable is an axial tension force, or the controllable speed variable is a rotational speed, and the response variable is a torque.

15. The system of claim 14 wherein the controllable speed variable and the response variable are referenced to a top end of the drillstring.

16. The system of claim 15 wherein the drive is configured to control at least a rotation mechanism coupled proximal the top end of the drillstring or a hoisting mechanism coupled proximal the top end of the drillstring.

17. The system of claim 13 wherein the drive is further configured to cancel the first adjustment at the end of the control period or to return the controllable speed variable to the operator set speed at the end of the control period.

18. The system of claim 17 wherein the drillstring further comprises a drill bit at the lower end;

wherein the controllable speed variable is rotational speed and the response variable is torque, referenced to a top end of the drillstring; and wherein the drive is further configured to start the first adjustment before the bit has started to rotate or before the torque has reached its first maximum.

19. The system of claim 13 further comprising a feedback based oscillation dampening system configured to make a second adjustment to the controllable speed variable by adding a closed-loop-controlled speed variation to the operator set speed command, or by adding the closed-loop-controlled speed variation to the first adjustment.

* * * * *